US006040015A

United States Patent [19]

Nakao et al.

[11] Patent Number: 6,040,015

[45] Date of Patent: Mar. 21, 2000

[54] PROCESS FOR FORMATION OF MULTILAYER FILM

[75] Inventors: Yasushi Nakao, Oobu; Shigeru Nakamura, Owariasahi, both of Japan

[73] Assignee: Kansai Paint Co. Ltd., Hyogo-Ken, Japan

[21] Appl. No.: 09/078,686

[22] Filed: May 14, 1998

[30] Foreign Application Priority Data

May 15, 1997 [JP] Japan ..... 9-125112

[51] Int. Cl.[7] ..... B05D 1/36

[52] U.S. Cl. ..... 427/407.1; 427/409; 428/411.1; 428/423.1; 428/457; 428/458; 428/461

[58] Field of Search ..... 427/407.1, 409, 427/410, 192, 216, 218; 106/403

[56] References Cited

U.S. PATENT DOCUMENTS

| | | | |
|---|---|---|---|
| 3,816,155 | 6/1974 | Iverson et al. | 427/274 |
| 4,158,074 | 6/1979 | Uchiyama et al. | 427/216 |
| 4,820,552 | 4/1989 | Espinosa-C. et al. | 427/216 |
| 5,037,475 | 8/1991 | Chida et al. | 106/403 |
| 5,108,796 | 4/1992 | Yamanaka et al. | 427/388.1 |
| 5,147,453 | 9/1992 | Panush et al. | 427/216 |
| 5,198,026 | 3/1993 | Nishimura et al. | 427/216 |
| 5,213,618 | 5/1993 | Souma et al. | 427/218 |
| 5,474,605 | 12/1995 | Schmid et al. | 427/216 |
| 5,558,705 | 9/1996 | Keemer et al. | 106/403 |
| 5,693,134 | 12/1997 | Stephens | 427/218 |
| 5,718,753 | 2/1998 | Suzuki et al. | 106/403 |
| 5,718,950 | 2/1998 | Komatsu et al. | 427/405 |
| 5,766,334 | 6/1998 | Hashizume et al. | 427/218 |
| 5,814,686 | 9/1998 | Micale et al. | 523/205 |
| 5,855,660 | 1/1999 | Bujard et al. | 106/418 |
| 5,863,321 | 1/1999 | Crumley et al. | 106/404 |

*Primary Examiner*—Diana Dudash
*Attorney, Agent, or Firm*—Huntley & Associates

[57] ABSTRACT

A process for forming a multilayer film, which comprises applying, onto a substrate, (A) a liquid solid-color coating which comprises a thermosetting resin composition and a metal powder coated with a coloring pigment, and (B) a clear coating in this order without substantially curing the resulting films of the coatings (A) and (B) and then heating the two films to crosslink and cure them simultaneously. The process of the present invention provides a multilayer film of smaller thickness, excellent hiding power and improved properties such as surface smoothness, chipping resistance and the like.

12 Claims, No Drawings

PROCESS FOR FORMATION OF MULTILAYER FILM

BACKGROUND OF THE INVENTION

1. Field of the Invention

The present invention relates to a process for forming a multilayer film comprising a solid-color coating film and a clear coating film. More particularly, the present invention relates to a process for forming a multilayer film having reduced thickness and improved properties such as hiding power, surface smoothness, chipping resistance and the like.

2. Description of the Prior Art

Previous processes for forming a multilayer film include applying a solid-color coating and a clear coating onto a substrate on a wet-on-wet basis, and heat-curing the films. Various coloring agents can be used in such previously known processes, including inorganic and organic coloring pigments such as titanium dioxide, zinc white, carbon black, Cadmium Red, Molybdenum Red, Chrome Yellow, chrome oxide, Prussian Blue, Cobalt Blue, Azo pigments, Phthalocyanine pigments, Quinacridone pigments, Isoindoline pigments, threne derivative pigments, perylene derivative pigments and the like.

The multilayer film formed by the above approach can lack sufficient hiding power for solid-color film depending on the kind of pigment used (which can necessitate the formation of a thick solid-color film, for example, 25 micrometers or more) and which can be inferior in color stability. These drawbacks of the multilayer film can be very serious when the multilayer film is formed on the body panel of an automobile wherein the appearance of the film is important.

SUMMARY OF THE INVENTION

The present invention eliminates the above-mentioned drawbacks in the multilayer film of the prior art and provides a novel process for forming a multilayer film superior in color stability, having improved hiding power, chipping resistance and surface smoothness. These properties can be achieved in a film of reduced thickness as compared to the prior art. Furthermore, the process of the present invention provides a means of preventing the intermixing of the solid-color coating film and the clear coating film.

Specifically, the present invention provides a process for forming a multilayer film comprising applying to a substrate, in the following order:

(A) a liquid solid-color coating comprising at least one thermosetting resin composition and at least one metal powder coated with at least one coloring pigment, and (B) a clear coating and heating the resulting substantially uncured coating films to crosslink and cure them simultaneously.

DETAILED DESCRIPTION OF THE INVENTION

The present invention will be more fully understood by reference to the following description and examples.

In the process for forming a multilayer film according to the present invention, the solid-color coating (A) can be coated directly on a metallic or plastic substrate such as an automobile body part or the like. It is generally preferred, however, that the substrate be pre-coated with a primer and/or an intermediate coating, and then cured.

Primer

Cationic electrocoating or anionic electrocoating can be used to coat the substrate with a primer, however, cationic electrocoating is generally preferred in view of the superior corrosion resistance that can be obtained by this process.

The cationic electrocoating process can include the following steps. The primer coating can be obtained by adding, as necessary, a crosslinking agent, a pigment and other coating additives to an aqueous solution or dispersion of a salt of a cationizable group-containing polymeric substance. The cationizable group-containing polymeric substance includes, for example, those substances obtained by modifying a base resin (e.g. an acrylic resin or an epoxy resin) with an amino compound or the like to introduce a cationizable group into the base resin. By neutralizing the cationizable group-containing polymeric substance with an acid such as organic acid, inorganic acid or the like, an aqueous solution or dispersion can be obtained. As the crosslinking agent, it is preferable to use a blocked polyisocyanate compound, an alicyclic epoxy resin or the like.

A metallic substrate is immersed into a bath as a cathode, and an electric current is passed between the cathode and an anode under ordinary conditions to apply the electrocoating onto the substrate. The thickness of the resulting electrocoating film can be determined as desired, depending upon the application purpose but preferably is about from 10 to 30 micrometers as cured. The primer coating can be crosslinked and cured by heating at a temperature of about from 140 to 200° C. for about from 10 to 40 minutes.

Intermediate coating

An intermediate coating can be applied on top of the primer. The intermediate coating can be a liquid coating composition comprising a thermosetting resin composition and a solvent as main components and, as necessary, a coloring pigment, an extender pigment and other coating additives. The intermediate coating serves to enhance the final multilayer film by improved smoothness, distinctness of image gloss, luster and the like.

Specific examples of the thermosetting resin composition used in the intermediate coating are those compositions obtained by adding, to a base resin such as acrylic resin, polyester resin, alkyd resin or the like, having a crosslinkable functional group such as hydroxyl group or the like, a crosslinking agent such as melamine resin, urea resin, blocked or unblocked polyisocyanate compound or the like. The solvent includes an organic solvent and/or water.

The intermediate coating can be applied on the crosslinked and cured film resulting from the electrodeposition of the primer, or it can be applied to the uncured primer film, by electrostatic coating, air spraying, airless spraying or the like. The preferable thickness of the intermediate coating film is about from 10 to 50 micrometers as cured. The film can be crosslinked and cured by heating, at a temperature of about from 100 to 170° C. for about from 10 to 40 minutes.

According to the process of the present invention, after the intermediate coating film has been crosslinked and cured, a solid-color coating (A) is applied.

Solid-color coating (A)

The solid-color coating (A) used in the process of the present invention can be a liquid solid-color coating composition comprising a thermosetting resin composition and a metal powder coated with a coloring pigment, and is distinguished from coating compositions capable of forming a light-iridescent metallic coating film or a light-iridescent coating film.

The metal powder coated with a coloring pigment used in the solid-color coating (A) substantially prevents the transmission of the light. As a result, the solid-color coating (A) comprising said metal powder coated with a coloring pigment has an excellent hiding power and can sufficiently hide the sublayer even in a thin film thickness (as cured) of about 25 micrometers or less, particularly about from 5 to 15 micrometers, irrespective of the hue of the coloring pigment. Moreover, in the process of the present invention, substantially no intermixing occurs between the uncured film of the solid-color coating (A) and the clear coating (B) applied thereon.

The thermosetting resin composition used in the solid-color coating (A) is preferably a composition comprising a base resin such as acrylic resin, polyester resin, alkyd resin or the like, having a crosslinkable functional group such as hydroxyl group or the like and a crosslinking agent such as amino resin (e.g. melamine resin or urea resin) or the like.

The metal powder coated with a coloring pigment used in the solid-color coating (A) is a metal powder, the surface of which is coated with a coloring pigment. There is no strict restriction as to the shape of the metal powder, but flake is preferable from the standpoint of improving the hiding power of the solid-color coating (A). The metal powder preferably has an average particle diameter of 10 micrometers or less, particularly about from 3 to 7 micrometers. Herein, "average particle diameter" is a median diameter obtained by a laser diffraction scattering method using LA-500 (trade name) produced by Horiba, Ltd. (also hereinafter the same applies). The metal powder is preferably a metallic powder of aluminum, copper, stainless steel, brass, an alloy of these metals and the like. The particle surfaces can be treated with a silane coupling agent or the like.

The metal powder coated with a coloring pigment can be obtained according to known methods, such as by coating the surface of the metal powder with an inorganic and organic coloring pigment such as titanium dioxide, zinc white, carbon black, Cadmium Red, Molybdenum Red, Chrome Yellow, chrome oxide, Prussian Blue, Cobalt Blue, Azo pigments, Phthalocyanine pigments, Quinacridone pigments, Isoindoline pigments, threne derivative pigments, perylene derivative pigments and the like. The thus-obtained metal powder is a solid-colored particle and has no glittering metallic appearance.

The solid-color coating (A) can further comprise, as necessary, an ordinary coloring pigment as long as the hiding power of the film of the solid-color coating (A) is not impaired.

In the solid-color coating (A), there is no strict restriction as to the amount of the metal powder coated with a coloring pigment, but the preferable amount is generally about from 0.1 to 30 parts by weight, particularly about from 1 to 7 parts by weight, of the metal powder coated with a coloring pigment, per 100 parts by weight of the total solid content of the thermosetting resin composition in the solid-color coating (A).

In the present invention, by using the metal powder coated with a coloring pigment in the solid-color coating (A), it is possible to form the film of the solid-color coating (A) that is smaller in thickness than previously disclosed solid-color coatings. Furthermore, the resulting film formed from the solid-color coating can have a hiding power (as cured) of about 25 micrometers or less, particularly about from 5 to 15 micrometers.

In the present application, "hiding power" refers to a minimum film thickness in which the color of the sublayer cannot be recognized by the naked eye. Specifically, when a film is formed on a black and white checkered substrate and visual observation is made from above the film, "hiding power is the minimum thickness of film formed on the substrate at which the black and white color of the substrate is unrecognizable.

The solid-color coating (A) can be prepared by a variety of methods, including dispersing the above-mentioned components in a solvent, for example, an organic solvent and/or water. The resulting cured film of the solid-color coating (A) alone has a chromatic or achromatic solid-color and shows no or substantially no glittering metallic appearance.

The film elongation ratio of the solid-color coating (A) at 20° C. is preferably about from 2.5 to 50%, particularly about from 5 to 35%, in its cured film state. When the film elongation ratio deviates from this range, the resulting multilayer film generally has reduced chipping resistance, smoothness, impact resistance and the like. The film elongation ratio can be easily controlled by changing the kinds, properties, etc. of the basic resin and crosslinking agent used in the solid-color coating (A).

Herein, "film elongation ratio" referred to for the solid-color coating (A), is a value obtained when the measurement was made for a film formed by heat-curing the solid-color coating (A) alone. Specifically, the film elongation ratio is obtained by coating the solid-color coating (A) on a tinplate sheet with a film thickness of about 15 micrometers as cured, heat-curing the resulting film at 140° C. for 30 minutes, separating the cured film by a mercury amalgamation method, cutting the separated film into a rectangular test piece of 20 mm (length)×5 mm (width), and subjecting the test piece to a tensile test at a tensile speed of 20 mm/per minute at 20° C. using a universal tensile strength tester with a controlled temperature bath (Autograph S-D, a product of Shimadzu Corporation) until the test piece is ruptured.

In the present invention, the solid-color coating (A) can be preferably applied on the crosslinked and cured film of the intermediate coating in a film thickness of about 25 micrometers or less, particularly about from 5 to 15 micrometers as cured by electrostatic coating, air spraying, airless spraying or the like. Preferably, the film of the solid-color coating (A) is dried at room temperature or higher (100° C. or less is preferable) without crosslinking and curing it, and then a clear coating (B) is applied thereon.

Clear coating (B)

The clear coating (B) can be applied on the uncrosslinked film of the solid-color coating (A) and is a liquid coating composition comprising a thermosetting resin composition and a solvent, and is capable of forming a transparent film.

The thermosetting resin composition can optionally include, for example, a composition comprising a base resin such as acrylic resin, polyester resin, alkyd resin or the like, having a crosslinkable functional group (e.g. hydroxyl group) and a crosslinking agent such as amino resin (e.g. melamine resin or urea resin), polyisocyanate compound or the like. Thermosetting resin composition without the crosslinking agents can also be used, as disclosed in U.S. Pat. Nos. 4,650,718, 4,703,101, 4,681,811, 4,772,672, 4,895,910, 5,026,793, 5,284,919, 5,389,727, and 5,274,045, EP-A-353,734 and 559,186.

An organic solvent and/or water can be used in the clear coating (B) of the present invention. The clear coating (B) can be prepared by a variety of methods including dissolving or dispersing the thermosetting resin composition in the solvent. The clear coating (B) can further comprise, as necessary, a coloring pigment, a metallic pigment, a light-iridescent pigment, an ultraviolet absorber and the like as long as the transparency of the film of the clear coating (B) is not impaired. The clear coating (B) can be applied on the uncured film of the solid-color coating (A) by various methods such as electrostatic coating, air spraying, airless spraying or the like. The clear coating (B) should be applied so that the resulting film has a thickness of about from 10 to 70 micrometers as cured.

According to the present process, a multilayer film can be obtained by applying, onto a substrate, the solid-color coating (A) and the clear coating (B) in this order without substantially curing the resulting films of the coatings (A) and (B), and then heating the two films to crosslink and cure them simultaneously at a temperature of about from 100 to 180° C. for about from 10 to 40 minutes.

The present process for formation of a multilayer film can provide the following effects.

(1) Since there no intermixing occurs when the clear coating (B) is directly applied on the uncured film of the solid-color coating (A), the multilayer film formed is superior in finish appearance.

(2) Since the solid-color coating (A) shows an excellent film hiding power, the total thickness of the multilayer film formed can be made smaller.

(3) The multilayer film formed has improved properties (e.g. improved smoothness and chipping resistance).

The present invention is hereinafter described more fully by way of the following Examples and Comparative Examples, in which parts and percentages are presented by weight. In these Examples and Comparative Examples, the following materials are used:

(1) Primer (applied by cationic electrocoating).

ELECRON 9400 HB (a trade name, a product of Kansai Paint Co., Ltd., an epoxy resin polyamine-blocked polyisocyanate compound type).

(2) Intermediate coating.

TP-37 PRIMER SURFACER (a trade name, a product of Kansai Paint Co., Ltd., a polyester resin-melamine resin type, an organic solvent type).

(3) Solid-color coating (A).

Organic solvent type coatings obtained by mixing a polyester resin, a melamine resin and a metal powder coated with a coloring pigment in the proportions shown in Table 1. In Table 1, the amount of each component is shown in a solid content ratio.

In Table 1, (*1) A phthalic anhydride/hexahydrophthalic anhydride type polyester resin (number-average molecular weight=about 4,000, hydroxyl value =82, acid value =7).

(*2) U-Van 28–60 (a product of MITSUI TOATSU CHEMICALS, INC.).

(*3) A fine aluminum powder having a particle diameter of 3 to 7 micrometers wherein its surface is coated with Quinacridone Red pigment.

(*4) RT355D (a product of CIBA GEIGY, LTD., dichroloquinacridone).

(*5) Each of the solid-color coatings (A-1) to (A-3) was coated on a tinplate sheet in a film thickness of 15 micrometers as cured, and then heat-cured at 140° C. for 30 minutes. The cured film was separated by a mercury amalgamation method and cut into a test sample of 20 mm (length)×5 mm (width). The test sample was subjected to a tensile test at 20° C. at a tensile speed of 20 mm/per minute using a universal tensile tester with a controlled temperature bath (Autograph S-D, a product of Shimadzu Corporation), and an elongation ratio (%) was measured when the test sample was ruptured.

(*6) Coating films were formed on a black and white substrate of checkered pattern, in various film thickness. A minimum film thickness (micrometer) when the black and white colors could not be distinguished by the naked eye, was measured.

(4) Clear coating (C).

MAGICRON CLEAR (a trade name, a product of Kansai Paint Co., Ltd., an acrylic resin-melamine resin type, an organic solvent type).

EXAMPLES AND COMPARATIVE EXAMPLES

The above-mentioned samples were applied and heat-cured according to the coating steps shown in Table 2, to form multilayer films. The films were tested for performances and the results are shown in Table 2.

The cationic electrocoating was electrocoated on a degreased and zinc phosphate-treated steel plate, by an ordinary method, so as to give a film of 20 micrometers in thickness as cured (hereinafter, thickness refers to thickness as cured). The coated cationic electrocoating was heated at 170° C. for 30 minutes for curing. On the cured film of the cationic electrocoating was coated the intermediate coating to give a film of 30 micrometers in thickness. The coated intermediate coating was heated at 140° C. for 30 minutes for curing.

On the cured film of the intermediate coating, solid-color coatings (A-1) to (A-3) were applied by the use of a minibell type rotary electrostatic coating machine under the conditions of discharge amount=150 cc, 50,000 rpm, shaping pressure=1 kg/cm$^2$, gun distance=30 cm, booth temperature=20° C. and booth humidity=75%. The film thickness of the solid-color coating (A) was 15 to 30 micrometers.

The resulting plate was allowed to stand in the booth for 5 minutes. On the uncured film of the solid-color coating (A), the clear coating (B) was applied by the use of a minibell type rotary electrostatic coating machine under the conditions of discharge amount=300 cc, 40,000 rpm, shaping pressure=5 kg/cm$^2$, gun distance=30 cm, booth temperature 20° C. and booth humidity=75%. The film thickness of the clear coating (B) was 40 micrometers.

The resulting plate was allowed to stand at room temperature for 3 minutes and then heated at 140° C. for 30 minutes in a dryer of hot air circulation type to subject the two-layered film of the solid-color coating (A) and the clear coating (B) to simultaneous curing.

The performances of each resulting multilayer film was measured and rated as follows.

Smoothness: Rated visually according to the following yardstick.

a: Good.

b: Slight surface roughening.

c: Striking surface roughening.

Chipping resistance: Measured using a gravelometer and 100 g of No. 7 crushed stones under the conditions of air pressure=4.5 kg/cm$^2$ and angle=450. Rated visually according to the following yardstick.

a: No or slight scar caused by impact was seen on part of the clear coating film.

b: Solid-color coating is slightly exposed owing to the partial peeling of clear coating film.

c: Solid-color coating is remarkably exposed owing to the peeling of clear coating film.

Finish appearance: The color stability of the multilayer film was examined visually and rated according to the following yardstick.

a: Color stability is good.

b: Color stability is poor.

The test results show that the coatings resulting from the present invention, shown in Examples 1 and 2, using metal powder coated with coloring pigment, exhibit superior performance over the coatings resulting from a process using coloring pigment alone, even when used in greater loadings. Specifically, the coatings resulting from the present invention exhibit superior chipping resistance and appearance, even at a lower thickness.

TABLE 1

| | Solid-color coating (A) | | |
|---|---|---|---|
| | A-1 | A-2 | A-3 |
| Polyester resin (*1) | 65 | 70 | 75 |
| Melamine resin (*2) | 35 | 30 | 25 |
| Colored metal powder (*3) | 4 | 6 | — |
| Coloring pigment (*4) | — | — | 10 |
| Elongation ration (%) (*5) | 25 | 28 | 8 |
| Hiding power (μm) (*6) | 14 | 10 | 28 |

TABLE 2

| | | Examples | | Comparative Example |
|---|---|---|---|---|
| | | 1 | 2 | 3 |
| Electrocoating | Symbol | ELECRON 9400 HB | | |
| | Curing | 170° C. × 30 min | | |
| Intermediate coating | Symbol | TP-37 PRIMER SURFACER | | |
| | Curing | 140° C. × 30 min | | |
| Solid-color coating (A) | Symbol | A-1 | A-2 | A-3 |
| | Film thickness (μm) | 15 | 15 | 30 |
| | Drying | Room temp. × 5 min | | |
| Clear coating (B) | Symbol | MAGICRON CLEAR | | |
| | Curing | 140° C. × 30 min | | |
| Performance test results | | | | |
| Smoothness | | a | a | a |
| Chipping resistance | | a | a | b |
| Finish appearance | | a | a | b |

We claim:

1. A process for forming a multilayer film comprising applying to a substrate, in the following order:

(A) a liquid solid-color coating comprising at least one thermosetting resin composition and at least one metal powder coated with at least one coloring pigment, and (B) a clear coating and heating the resulting substantially uncured coating films to crosslink and cure them simultaneously.

2. A process of claim 1 wherein the film formed from the solid-color coating (A) has a film elongation ratio of about from 2.5 to 50% at about 20° C.

3. A process of claim 1 wherein the film formed from the solid-color coating (A) has a film elongation ratio of about from 5 to 35% at about 20° C.

4. A process of claim 1 wherein the film formed from the solid-color coating (A) has a cured film hiding power of less than about 25 micrometers.

5. A process of claim 1 wherein the film formed from the liquid solid-color coating (A) has a cured film hiding power of about from 5 to 15 micrometers.

6. A process of claim 1 wherein the liquid solid-color coating (A) comprises about 100 parts by weight of a thermosetting resin composition and about from 0.1 to 30 parts by weight of a metal powder coated with a coloring pigment.

7. A process of claim 1 wherein the liquid solid-color coating (A) is a liquid coating composition comprising about 100 parts by weight of a thermosetting resin composition and about from 1 to 7 parts by weight of a metal powder coated with a coloring pigment.

8. A process of claim 1 wherein the film formed from the liquid solid-color coating (A) has a cured thickness of less than about 25 micrometers.

9. A process of claim 1 wherein the film formed from the liquid solid-color coating (A) has a cured thickness of about from 5 to 15 micrometers.

10. A process of claim 1 wherein the clear coating (B) has a cured thickness of about from 10 to 70 micrometers.

11. A process of claim 1 wherein the films formed from the coatings (A) and (B) are heated at a temperature of about from 100 to 180° C. to crosslink and cure the films simultaneously.

12. An article comprising a coated substrate obtained by the process of claim 1.

* * * * *